United States Patent [19]

Tetrault et al.

[11] Patent Number: 4,835,883

[45] Date of Patent: Jun. 6, 1989

[54] VENTILATED SOLE SHOE CONSTRUCTION

[76] Inventors: Edward J. Tetrault; Larry D. Land, both of 16757 Vasser St., Forest Lake, Minn. 55025

[21] Appl. No.: 135,593

[22] Filed: Dec. 21, 1987

[51] Int. Cl.[4] ..... A43B 7/06

[52] U.S. Cl. ..... 36/3 R; 36/3 B; 128/588

[58] Field of Search ..... 36/3 R, 3 B, 3 A, 29, 36/44, 43; 128/588, 594

[56] References Cited

U.S. PATENT DOCUMENTS

| | | | |
|---|---|---|---|
| 2,545,062 | 3/1951 | Whittington | 36/3 R |
| 2,701,923 | 2/1955 | Toman | 36/3 R |
| 3,029,530 | 4/1962 | Eaton | 36/3 R |
| 3,120,712 | 2/1964 | Menken . | |
| 4,016,662 | 4/1977 | Thompson . | |
| 4,237,625 | 12/1980 | Cole et al. . | |
| 4,364,189 | 12/1982 | Bates . | |
| 4,547,978 | 10/1985 | Radford . | |
| 4,602,441 | 7/1986 | Sakkat . | |

FOREIGN PATENT DOCUMENTS

| | | | |
|---|---|---|---|
| 2809011 | 8/1979 | Fed. Rep. of Germany | 36/3 B |
| 3103230 | 1/1982 | Fed. Rep. of Germany | 36/3 R |
| 2521407 | 8/1983 | France | 36/3 B |
| 88634 | 1/1957 | Norway | 36/3 R |

*Primary Examiner*—James Kee Chi

*Attorney, Agent, or Firm*—Leon Gilden

[57] ABSTRACT

Shoe construction is set forth effecting ventilation of the sole portion of the shoe. Air external to the shoe is provided access interiorly thereof by means of a conduit directing such air to a sole portion including a plurality of flexible vane elements formed with openings therein. Normal weight distribution about the weight supportive sole portion of the shoe effects a pumping action by means of the vane elements to enable air to circulate therethrough and ultimately to a user's foot through a porous cushioning layer overlying said sole.

2 Claims, 1 Drawing Sheet

VENTILATED SOLE SHOE CONSTRUCTION

BACKGROUND OF THE INVENTION

1. Field of the Invention

The present invention relates to shoe construction, and more particularly pertains to a new and improved shoe construction including a ventilated sole wherein upon the shoe being utilized ventilation to the weight supportive sole portion of the shoe is effected.

2. Description of the Prior Art

The use of varying sole construction adapted for varying attendant uses has been developed in the prior art. As may be appreciated, the prior art constructions have been available to address specialized problem situations in the use of footwear. In this connection, there have been several attempts to develop varying sole constructions which may effectively and readily address the problems associated with the foot wear, such as providing varying thrust areas and support areas in an insole as well as a ventilation means. For example, U.S. Pat. No. 4,547,978 to Radford formed with a sole including a plurality of intercommunicating cavities that upon walking by an individual the varying cavities in the intercommunicating passageways pump air therebetween and through a permeable inner sole to alleviate perspiration and the like associated with conventional footwear. The Radford patent sets forth an enclosed system whereby only entrapped air within the shoe is circulated limiting its ventilating qualities, as opposed to the instant invention wherein an outside air source is directed to an inner sole construction including a plurality of vanes that continuously pump and direct such air through a permeable cushioning inner sole layer.

U.S. Pat. No. 3,120,712 to Menken sets forth a pneumatic or fluid inner sole that may be selectively filled for providing differential cushioning to a shoe sole providing support to those areas anatomically requiring such. The Menken patent fails to provide means for aerating an inner sole to a user's foot.

U.S. Pat. No. 4,016,662 to Thompson sets forth a shoe construction including a chamber within the inner sole that may be filled with fluid to provide varying stiffness of foot support to a shoe.

U.S. Pat. No. 4,237,625 to Cole, et al., provides cavities including fluid passages and chambers therein to facilitate a shock absorption effect in normal thrust situations involving the use of conventional footwear.

U.S. Pat. No. 4,364,189 to Bates sets forth a support shoe with varying portions of differing firmness to provide various support areas and stability to a user's foot.

As such, it may be appreciated that there is a continuing need for a new and improved ventilated sole in shoe construction which addresses both the problem of support and aeration of a shoe's interior, and in this respect, the present invention substantially fulfills this need.

SUMMARY OF THE INVENTION

In view of the foregoing disadvantages inherent in the known types of inner soles in shoe construction now present in the prior art, the present invention provides a ventilated sole shoe construction wherein a plurality of chambers formed within an inner sole includes porting to direct air externally of the shoe interiorly thereof and thereafter direct same through a permeable inner sole to aerate a user's foot. As such, the general purpose of the present invention, which will be described subsequently in greater detail, is to provide a new and improved ventilated sole shoe construction which has all the advantages of the prior art inner soles in shoe construction and none of the disadvantages.

To attain this, the present invention comprises a shoe of conventional construction including an inner sole formed of a plurality of vaned membranes defining chambers therebetween with an air passageway to enable air externally of the shoe to gain access therein whereby through an accompanying porous overlying inner sole to said aforenoted chambers enables said air to be directed internally of the shoe.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ventilated sole shoe construction which has all the advantages of the prior art ventilated sole shoe constructions and none of the disadvantages.

It is another object of the present invention to provide a new and improved ventilated sole shoe construction which may be easily and efficiently manufactured and marketed.

It is a further object of the present invention to provide a new and improved ventilated sole shoe construction which is of a durable and reliable construction.

An even further object of the present invention is to provide a new and improved ventilated sole shoe construction which is susceptible of a low cost of manufacture with regard to both materials and labor, and which accordingly is then susceptible of low prices of sale to the consuming public, thereby making such ventilated sole shoe constructions economically available to the buying public.

Still yet another object of the present invention is to provide a new and improved ventilated sole shoe construction which provides in the apparatuses and methods of the prior art some of the advantages thereof, while simultaneously overcoming some of the disadvantages normally associated therewith.

Still another object of the present invention is to provide a new and improved ventilated sole shoe construction wherein porting directed exteriorly of a shoe enables air externally of a shoe to be directed internally thereof through a ventilated inner sole.

Yet another object of the present invention is to provide a new and improved sole construction wherein a plurality of chambers intercommunicating by means of openings formed in flexible vane elements effects pumping of said air throughout said inner sole and ultimately to the interior of the accompanying shoe.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
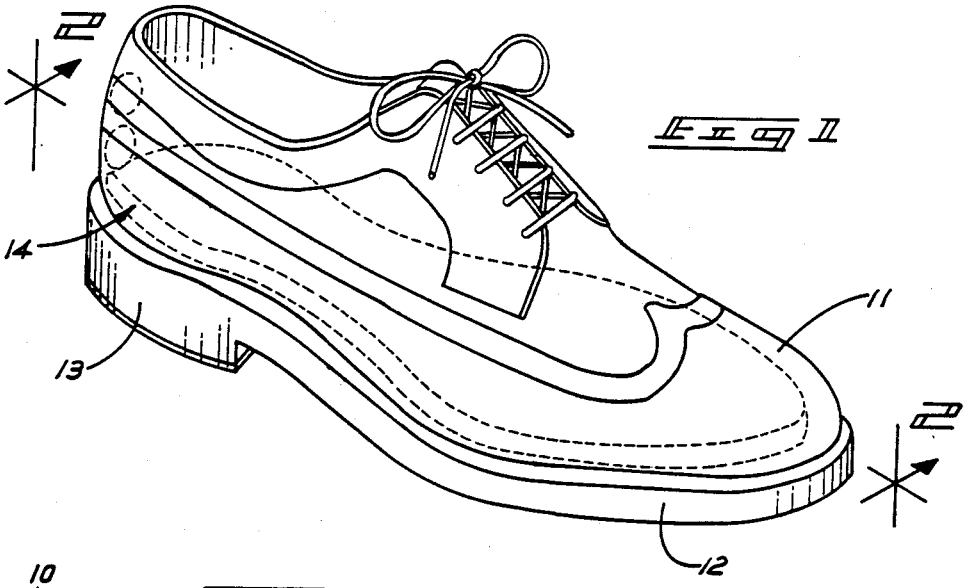
FIG. 1 is an isometric view of a conventional shoe including the instant invention.
Figure 2:
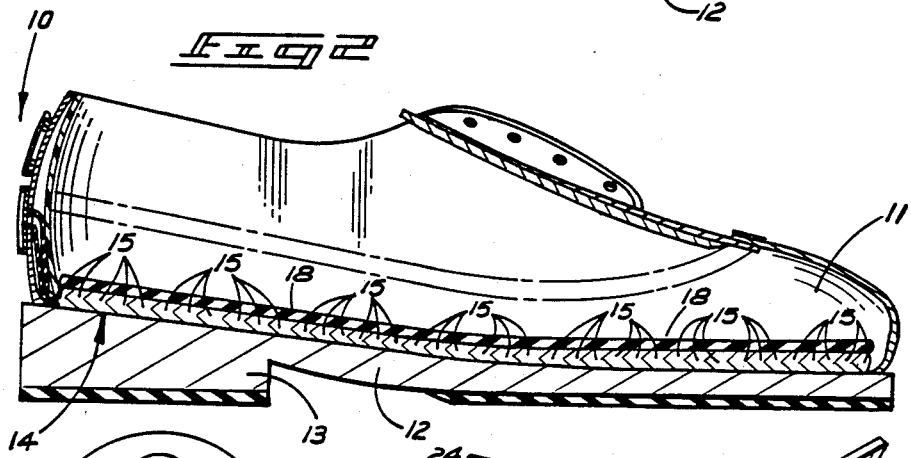
FIG. 2 is an orthographic view taken in elevation along the lines 2—2 of FIG. 1 in the direction indicated by the arrows.
Figure 3:
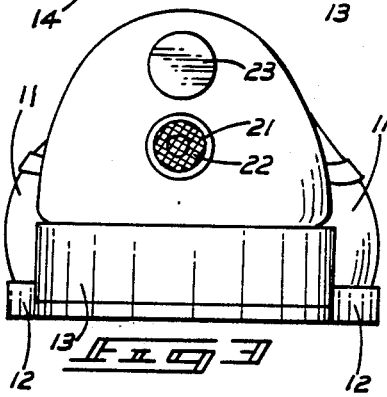
FIG. 3 is an orthographic rear view of the shoe set forth in FIG. 1.

With reference now to the drawings, and in particular to FIGS. 1 to 5 thereof, a new and improved ventilated sole shoe construction embodying the principles and concepts of the present invention and generally designated by the reference numeral 10 will be described.

Figure 4:
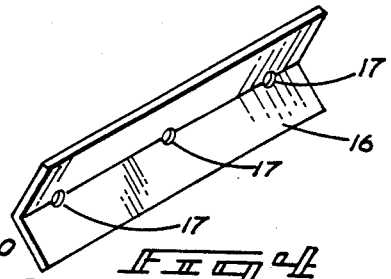
FIG. 4 is a detailed isometric view of a vane element of the instant invention.
Figure 5:
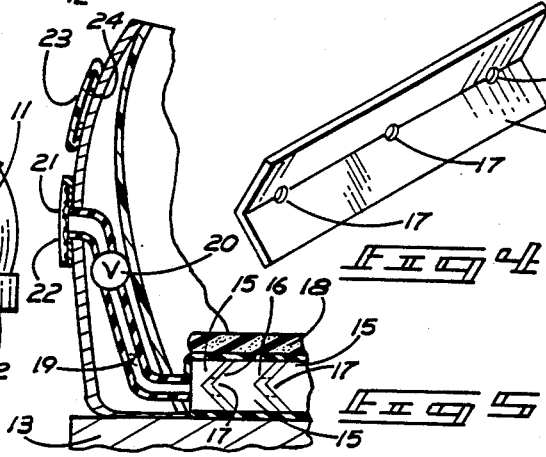
FIG. 5 is an orthographic view illustrating in detail the porting to the sole of the instant invention.

More specifically, it will be noted that the ventilated sole shoe construction 10 essentially comprises a conventional shoe including an upper 11 secured to or conventionally lasted to an underlying sole 12 including a heel portion 13. A ventilated sole 14 is formed with a plurality of chambers 15 separated by flexible vane elements 16. Vane elements 16 may be formed of any suitable material of polyethylene or plastic-like construction formed of memory retentent material. The vane elements 16 are formed with a plurality of openings 17 therein, as illustrated in FIGS. 4 and 5 respectively. The normal walking by a user of the ventilated shoe construction 10 effects a flexation of vane elements 16 tending to pump air and circulate same throughout the various chambers 15 through the associated openings 17.

Air exterior to said shoe construction is directed to said ventilating sole 14 by means of an associated conduit 19 formed with a check valve 20 therein. An external opening 21 is formed thereover a filtering screen 22 preventing unwanted debris from entering the conduit 19 and potentially plugging the various openings 17 formed within vane elements 16 to diminish the effectiveness of the instant invention.

When worn in particularly dusty areas or forums containing an excess of air-born particles, an associated plug 23 is removably carried by support boss 24 to enable the plug 23 to be secured about the opening 21 to effect closure thereof.

Air directed within the various chambers 15, as noted above, enters the interior of the shoe construction 10 via the associated cushioned inner sole 18 formed of any natural material such as leather that is inherently porous or alternatively may be formed of any suitable material such as plastic-like material with suitable porosity enabling the air within the various chambers 15 to be directed through the inner sole 15 to the underlying portion of a user's foot.

Advantageously, the air captured within the various chambers 15 not only provides the benefit of aeration but also cushions the walking of a user by the flexation capabilities of vanes 16 enhanced by the cushioning effect of the air within chambers 15. Check valve 20 is optionally in this combination but may be deleted for purposes of economy of manufacture and ease of construction.

As to the manner of usage and operation of the present invention, the same should be apparent from the above description. Accordingly no further discussion relative to the manner of usage and operation will be provided.

With respect to the above description then, it is to be realized that the optimum dimensional relationship for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ventilating sole construction for use in combination with a shoe comprising, a sole means including a ventilating sole contiguously positioned to an outer sole lasted to an upper of said sole, and said ventilating sole including a conduit means formed with two ends secured to said ventilating sole within the interior of said shoe at one end and to a source of air exteriorly of said shoe at its other end, and said ventilating sole including a plurality of chambers separated by vane means, and intercommunicating means enabling air introduced into said ventilating sole to be directed into said plurality of chambers, and wherein said intercommunicating means comprises a plurality of openings formed in each of said vane means, and wherein said vane means is formed in a generally "V" shaped memory retentent flexible material with said plurality of openings aligned and conformed at the apex of each of said vane means, and wherein a porous cushioned inner sole is secured in overlying relationship to said ventilating sole to enable air within said chambers to be directed through said porous inner sole to the interior of said shoe, and wherein said vane means are rearwardly directed with each apex rearwardly directed and positioned medially of said inner sole and said outer sole, said conduit means is formed with a screen overlying said conduit at its other end to prevent debris from entering said conduit, and wherein said conduit means includes a check valve to prevent air introduced into said ventilated sole from escaping from the plurality of chambers, and wherein a plug means is secured to a support boss overlying and proximate said other end of said conduit to enable said plug means to be manually positioned over said other end to plug same when ventilation of said ventilated sole is not desired.

2. A ventilated sole construction as set forth in claim 1 wherein said ventilated sole is integrally secured to said outer sole and sandwiched between said outer sole and said porous inner sole.

* * * * *